United States Patent [19]

Klein

[11] Patent Number: 4,981,179

[45] Date of Patent: Jan. 1, 1991

[54] THERMAL TRIGGERING DEVICE FOR SPRINKLERS FOR STATIONARY FIRE-EXTINGUISHING SYSTEMS

[76] Inventor: Wilfried Klein, Lindlarer Strasse 79, D-5063 Overath-Immekeppel, Fed. Rep. of Germany

[21] Appl. No.: 352,572

[22] Filed: May 16, 1989

[30] Foreign Application Priority Data

Jun. 10, 1988 [DE] Fed. Rep. of Germany ..... 3819749

[51] Int. Cl.[5] ..... A62C 37/14

[52] U.S. Cl. ..... 169/38; 169/37

[58] Field of Search ..... 169/37–41, 169/90, 58, 19, 26; 137/72, 74, 79

[56] References Cited

U.S. PATENT DOCUMENTS

| | | | |
|---|---|---|---|
| H121 | 9/1986 | Pieczykolan | 169/37 |
| 775,729 | 11/1904 | Mills | 169/39 |
| 1,700,591 | 1/1929 | Loepsinger | 169/38 |
| 1,797,919 | 3/1931 | Loepsinger | 169/38 |
| 2,085,987 | 7/1937 | Loepsinger | 169/39 X |
| 2,528,063 | 10/1950 | Loepsinger | 169/38 |
| 4,508,175 | 4/1985 | Pieczykolan | 169/38 |
| 4,609,047 | 9/1986 | Pieczykolan | 169/38 |
| 4,619,327 | 10/1986 | Pieczykolan | 169/38 |
| 4,732,216 | 3/1988 | Polan | 169/38 |
| 4,898,246 | 2/1990 | Riedle et al. | 169/38 |

FOREIGN PATENT DOCUMENTS

| | | | |
|---|---|---|---|
| 867654 | 1/1953 | Fed. Rep. of Germany | 169/41 |
| 2909977 | 10/1980 | Fed. Rep. of Germany | 169/41 |
| 2626649 | 8/1989 | France | 169/37 |
| 333412 | 8/1930 | United Kingdom | 169/38 |
| 1350991 | 4/1974 | United Kingdom | 169/41 |
| 2206489 | 1/1989 | United Kingdom | 169/38 |
| 2219500 | 12/1989 | United Kingdom | 169/38 |

*Primary Examiner*—Joseph F. Peters, Jr.
*Assistant Examiner*—James M. Kannofsky
*Attorney, Agent, or Firm*—Sprung Horn Kramer & Woods

[57] ABSTRACT

A thermal triggering device for sprinklers for stationary fire-extinguishing systems. The demands made on sprinklers for stationary fire-extinguishing systems are to the effect that increasingly shorter triggering times are demanded in order to be able to fight fire more quickly and more effectively. The novel triggering device should therefore have such a short triggering time that the response thereof in case of fire takes place as exactly as possible at the predetermined triggering temperature. The triggering element which is constructed as a glass bulb is at least supported on the sealing member of the sprinkler via a heat-insulating component, made from a corrosion-resistant material of high strength and low heat conductivity and also great heat absorption but low heat storage capacities, the component having a low mass and a large surface area and a small cross-section in the direction of the flow of heat.

20 Claims, 7 Drawing Sheets

FIG.10a
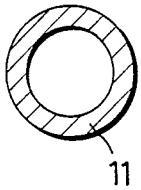
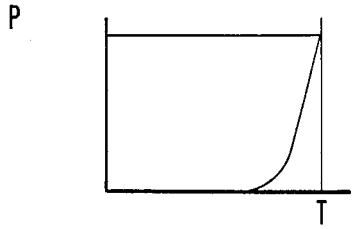
FIG.10d
FIG.10b
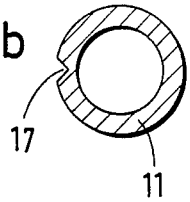
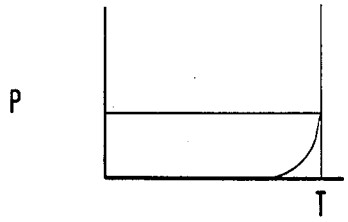
FIG.10e
FIG.10c
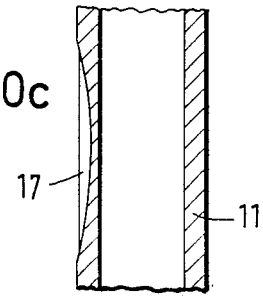

THERMAL TRIGGERING DEVICE FOR SPRINKLERS FOR STATIONARY FIRE-EXTINGUISHING SYSTEMS

BACKGROUND OF THE INVENTION

The invention relates to a thermal triggering device for sprinklers for stationary fire-extinguishing systems, with a temperature-dependent safety device which is designed as a glass bulb with a filling and supporting elements, which device until the moment of triggering holds a sealing member of the sprinkler in a closed or blocking position.

The demands made on sprinklers for stationary fire-extinguishing systems are to the effect that increasingly very much shorter triggering times are demanded in order to be able to fight fires arising more quickly and hence more effectively than before. An essential criterion for the triggering time of a sprinkler is the triggering inertia of its thermal triggering element, which is designed as a safety device. In relevant circles, the so-called RTI value has become internationally accepted as a measurement for the triggering inertia, RTI standing for the expression "Response Time Index", i.e. for the "inertia index". The RTI value is the time constant for the heating-up of the triggering element which occurs in an air current at a rate of 1 m/s. It is calculated according to the formula $$RTI = \tau \cdot u^{\frac{1}{2}},$$

whereby $\tau$=heat storage capacity/heat absorption capacity=-triggering inertia and u=the speed of the burnt gas and the heat storage capacity is defined as the required quantity of heat per °C. temperature increase measured in cal, kcal or Joules and the heat absorption capacity which is dependent on the air speed is defined as the total quantity of heat, measured in cal/sec, Joules/sec or also watts, flowing towards the triggering element from the surrounding air per °C. temperature difference between them per unit of time, e.g. per second.

In conventional sprinklers, this time constant is approximately 200 to 400 seconds. More recent developments of triggering elements which are designed as glass bulbs have far lower time constants, which are about one-fifth of the stated values. Such glass bulb triggering elements are described, for instance, in German patent No. 32 20 124 and in European patent application No. 0 215 331.

In German patent No. 32 20 124, the triggering time of the sprinkler is shortened by a solid insert which is arranged as is known in the glass bulb and acts as a displacement member being produced from a material, the heat capacity of which is lower than the heat capacity of the expansive liquid in the glass bulb, the volume of the expansive liquid in the glass bulb being decreased by the displacement member without the glass member having its dimensions changed and therefore being altered in its physical properties.

In contrast to this, in European patent application No. 0 215 331, a glass bulb which can quickly respond in accordance with the new requirements without considerable loss of strength and continuous loadability, one strives to thicken at least one end of the glass bulb with respect to the thin shank and give it a larger diameter than said shank.

In these two cases, one attempts to achieve the decrease in triggering inertia and hence the reduction of the triggering delay of the sprinklers by special formation of the glass bulb or its filling.

However, not only the magnitude of the triggering inertia RTI is decisive for the extent of the triggering delay of the sprinklers, but also another value, namely the so-called C-value, which is characteristic of the triggering delay as a result of the dissipation of heat from the triggering element via the sprinkler connection to the water-filled piping.

According to Document N 139 in ISO TC 21 SC 5 WG 1 by Gunnar Heskestad and Robert G. Bill, the temperature increase in the triggering element can be determined according to the formula $$\frac{d(\Delta Te)}{dt} = \frac{u^{\frac{1}{2}}}{RTI}\left[\Delta Tg - \frac{C}{u^{\frac{1}{2}}}\Delta Te\right]$$

whereby

ΔTe is the temperature of the triggering element minus the pipe temperature (≐ water temperature) in °C., u is the speed of the burnt gas in m/sec, ΔTg is the temperature of the burnt gas minus the pipe temperature (≐ water temperature) in °C.

$\tau$ the time constant of the triggering element at a given speed of the burnt gas in sec RTI $\tau \cdot u^{\frac{1}{2}}$ in sec $\cdot\sqrt{m/sec}$ and C is the parameter for the heat transfer by conduction of heat from the triggering element to the piping in $\sqrt{m/sec}$.

This formula can be used to demonstrate the temperature gradient in the triggering element and thus the triggering delay at different speeds of the burnt gas and burnt gas temperatures. Thus it can be used to demonstrate that the RTI value is the dominating parameter if there is a high supply of energy, for instance when there is a high speed of burnt gas and also a high temperature difference between the burnt gas and the triggering element.

This formula can also be used to demonstrate that the C-value is the dominating parameter if there is a low supply of energy, for instance when there is a low speed of burnt gas and also a small temperature difference between the burnt gas and the triggering element, and the C-value therefore has a great influence. The influence of the C-value may in this case be so large that the triggering element no longer responds, although the burnt gas temperature is considerably above the intended triggering temperature of the triggering element. In the case of fires which develop slowly, the triggering of the sprinklers is thereby prevented for a long time, i.e. greatly delayed, although the required value of the fire parameter "temperature" which is intended to trigger the sprinklers has already obviously been reached for some time or has even been exceeded, with the consequence that the fire can develop and spread to an unnecessarily large extent and thus unnecessarily extensive damage occurs before the fire-extinguishing system becomes operative, the C-value therefore has a great influence.

A high C-value may however also prove disadvantageous if, in the case of normally or rapidly developing fires and sprinklers mounted at a great height on the ceiling of the room, as a result of the mixing of the burnt gases with the surrounding air, a low burnt gas temperature and a low speed of burnt gas occur. The opportunity of fighting and thus safely extinguishing the fire at the earliest possible time is lost here as well.

Using investigations into a series of sprinklers which are common at present, inter alia those according to German patents Nos. 25 39 703 and 26 39 245, in a current of air at a speed of 1 m/s and with a temperature increase of approximately 0.5° C. per minute, and with a threaded connection of the sprinklers through which water flows at a temperature of approximately 20° C., i.e. in a test layout which fully corresponds to real fire conditions, it was noted that the sprinklers were only triggered at temperatures which were considerably higher than their nominal triggering temperatures. However, this means nothing other than that the known sprinklers require too long a time before they respond, so that fighting the fire in good time is jeopardised at least and thus there is a danger of unnecessarily extensive fire damage.

SUMMARY OF THE INVENTION

The object of the invention is to provide a thermal triggering device for sprinklers for stationary fire-extinguishing systems which have such a short triggering time that the response thereof in case of fire takes place as exactly as possible at the predetermined triggering temperature.

In the case of a thermal triggering device, this object is achieved by a configuration in accordance with the present invention.

The inventive measures achieve, to as great an extent as possible, the suppression of the dissipation of the heat which, upon the occurrence of a fire, is supplied to the triggering element, that is to say the glass bulb, by the burnt gases according to their speed and temperature, from the triggering element to the sealing member and if necessary even to the stirrup. The thermal energy which is supplied to the glass bulb according to the speed of the burnt gas and the burnt gas temperature therefore remains practically fully preserved, so that the glass bulb can heat up to the intended triggering temperature relatively quickly and upon reaching or exceeding it can be triggered without a delay in triggering occurring due to unwanted cooling as a result of heat transfer. The insulating effect of the heat-insulating component is naturally greater, the lower the thermal conductivity of the material used.

However, this alone would not be sufficient to prevent heat transfer from the triggering element to the sealing member which is connected to the piping or the water located therein to a sufficient extent. As can be gathered, for instance, from the article by Eduard J. Job, "Remarks on the Effect of Conductive Heat Loss with Regard to Multiple Sprinkler Head Operation" or US-PS 431 971 which is mentioned therein, it has already been known for about 100 years to counteract the heat loss from the triggering element to the piping connected thereto and the water located therein in sprinklers for automatic fire-extinguishing systems by using components made of heat-insulating material, i.e. material which is a poor conductor of heat, namely glass. Although without thereby achieving the desired effect, as was able to be ascertained by means of tests. Glass is indeed known to be a material which is very suitable per se as a heat-insulator, but the insulating effect is greatly impaired by the relatively large material cross-section, as is shown in the U.S. patent.

In accordance with the characterising clause of claim 1 of the invention, it is an essential criterion for the heat-insulating component that it should have a low mass, but a large surface area, and that in particular its cross-section should be small perpendicularly to the direction of the flow of heat. The quantity of heat per degree temperature difference dissipating via the heat-insulating component results from $$\frac{\text{heat conductivity value} \cdot \text{cross-section}}{\text{length}}$$

$$\left[\frac{\text{cal/cm sec grd} \cdot \text{cm}^2}{\text{cm}}\right]$$

the heat conductivity value being that of the material used for the heat-insulating component and the cross-section and length being the cross-sectional surface area and length of the component which are actually present.

As can be seen from this formula, the quantity of heat dissipating may be affected by the selection of a material having the lowest possible heat conductivity value and by reducing the actual cross-sectional surface area and also by increasing the length of the component in the manner desired, i.e. with the effect of the smallest possible heat transfer.

If, for instance, the $V_2A$ steel having 18% Cr and 8% Ni is selected for the heat-insulating component, according to Dubbel, Taschenbuch für den Maschinenbau, Springer Verlag, Vol. I, 12th edition, 1966, p. 572 there results a heat conductivity value of 0.039 cal/cm sec grd. As this material not only has the resistance to corrosion according to one feature of the invention, but also the high strength which is also a feature of the invention, the support load of e.g. 50 kp over a material cross-section of for instance 1 $mm^2$ actual cross-sectional surface area which acts on the heat-insulating material in the sprinkler can be reliably absorbed, so that in the case of a heat-insulating component of 1 cm length a value of $$\frac{0.039 \text{ cal/cm sec grd} \cdot 0.01 \text{ cm}^2}{1 \text{ cm}} = 0.00039 \text{ cal/sec grd}$$

would result.

Instead of the above-mentioned $V_2A$ steel, advantageously any other alloyed or non-alloyed metallic materials, but likewise also non-metallic materials having comparable properties may be used for the heat-insulating component. Whereas, for instance, copper is relatively unsuitable for this purpose due to its heat conductivity value which is many times higher and also due to its substantially lower strength, the construction of the heat-insulating component according to the invention from glass would be entirely practicable.

Further expedient configurations of the inventive concept are described in the sub-claims. For instance, it is possible to achieve a further reduction in the heat transfer due to the heat transmission resistance occurring between the individual parts by constructing the heat-insulating component from several individual parts. It is likewise possible to increase the surface area of the heat-insulating component considerably by attaching plates or the like made of highly heat-conductive material, for instance copper, with the effect that the heat-insulating component will be greatly heated up by the burnt gases when a fire occurs and thus forms a thermal barrier or a thermal buffer between the glass bulb and the sprinkler body, which prevents heat dissipation from the glass bulb, or even, with a skilful arrangement and configuration as well as dimensions, conducts heat to the glass bulb and thus accelerates the triggering thereof, in particular if the plates or the like are arranged on the heat-insulating component close to the end of the glass bulb and optionally also the plate closest to the glass bulb is in direct contact therewith. Here glass bulbs which are not thickened but are thin-walled at their ends also have positive results.

The invention is shown in embodiments in the drawings and will be described in greater detail below.

BRIEF DESCRIPTION OF THE DRAWINGS

FIGS. 10*a* and 10*b* show different configurations for the bulb, FIGS. 10*d* and 10*e* show the different response behaviour of a glass bulb with and without a predetermined breaking point, FIG. 10*c* shows an example of a possibility of configuration of a predetermined breaking point.

DETAILED DESCRIPTION OF THE INVENTION

Figure 1:
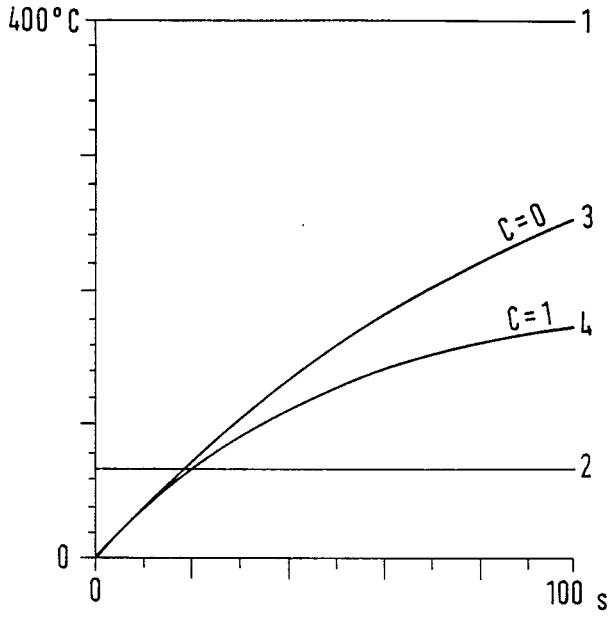
FIGS. 1 and 2 show the dominating influence of the RTI value in the case of a high supply of energy.
Figure 2:
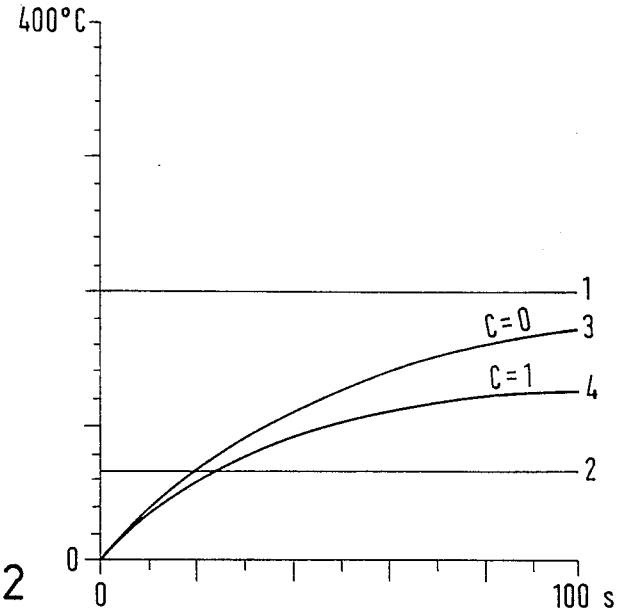

In the diagram of FIGS. 1 and 2, the time in seconds is plotted on the abscissa and the temperature in degrees Celsius on the ordinate. In FIG. 1, the burnt gas temperature according to line 1 is constantly 400° C. at a likewise constant speed of the burnt gas of 1 m/sec. The triggering temperature provided for is a constant 68° C. according to line 2 and the sprinkler starting or initial temperature is 0° C. As can be seen in the broken curves 3 and 4 for the values C=0 or C=1, these intersect the straight line 2 for the triggering temperature at only a small interval in time, namely at t=18 sec (C=0; curve 3) and t=20 sec (C=1; curve 4). It can be seen from this that the C-value only exerts a small and secondary influence on the achieving of the triggering temperature of 68° C. and the RTI value is the decisive parameter for the triggering behaviour according to the high supply of energy as a result of the high temperature difference between the burnt gas and the triggering element. For the sake of simplicity, it is assumed here that the pipe and water temperature remains constant at 0° C.

This also applies correspondingly with respect to the diagram of FIG. 2, in which the line 1 indicates a constant burnt gas temperature of 200° C. at a burnt gas speed of 4 m/sec. The triggering temperature provided for according to line 2 is again 68° C. and the sprinkler starting temperature is 0° C. Here too, the broken curves 3 for C=0 and 4 for C=1 intersect the straight line 2 for the triggering temperature at only a small interval in time from each other, namely at t=20 sec (C=0; curve 3) and t=23 sec (C=1; curve 4). Here too, the influence of the parameter C for the heat transfer by heat conduction from the triggering element to the piping or sprinkler body is thus of only secondary importance and the triggering behaviour is thus decisively determined by the RTI value.

Figure 3:
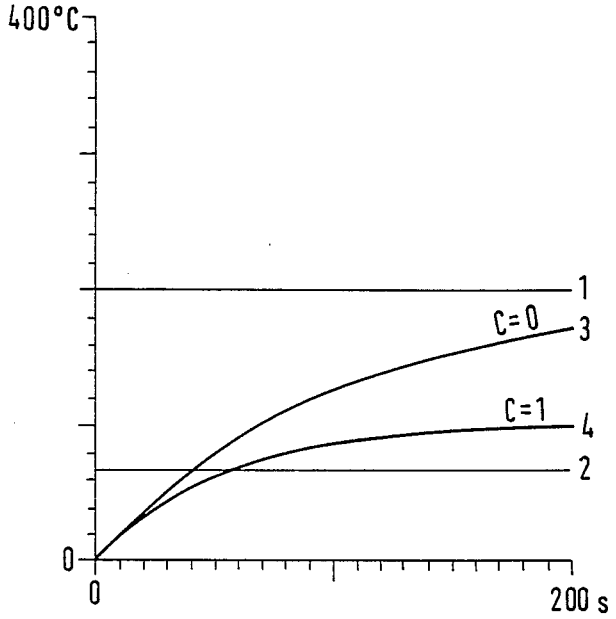
FIGS. 3 and 4 show the dominating influence of the C-value in the case of a low supply of energy.
Figure 4:
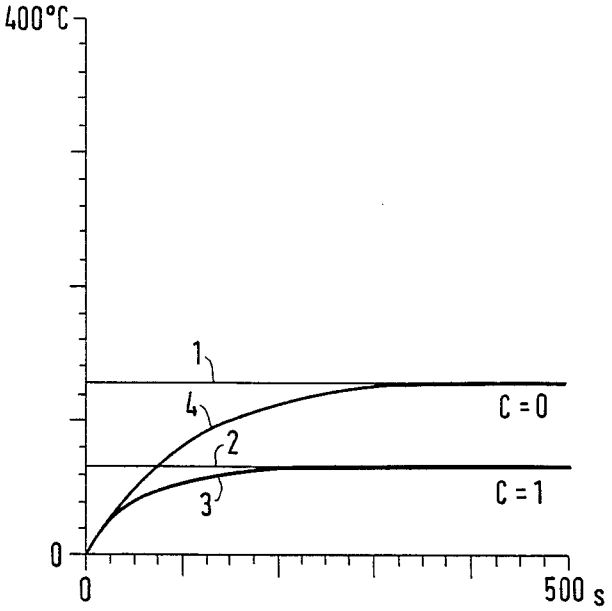
Figure 5C:
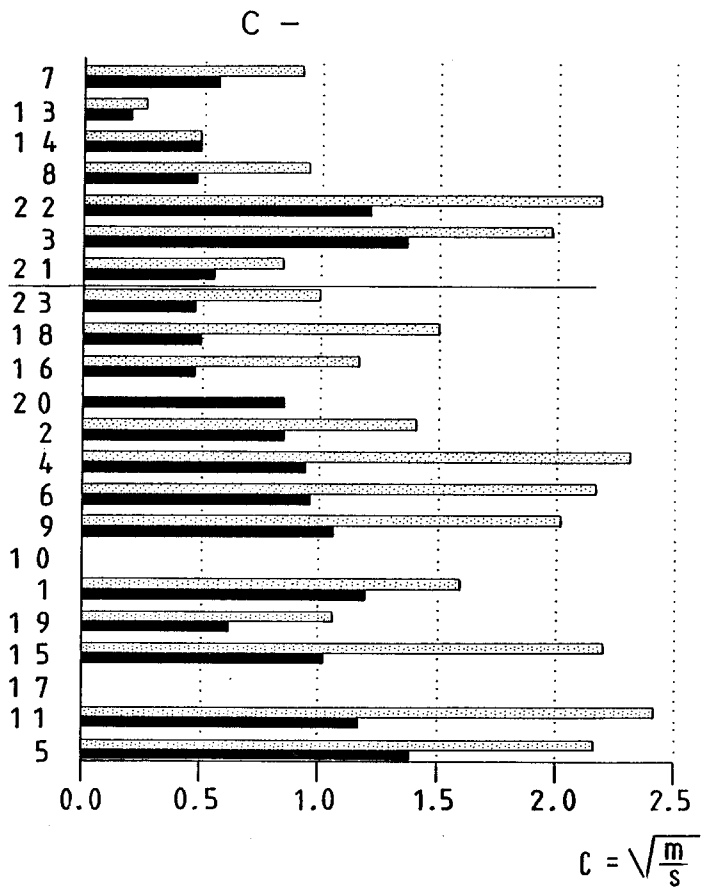
FIGS. 5*a* and 5*c* show in two bar charts the response behaviour of known and conventional sprinklers of the soldered and glass bulb types with respect to their RTI and C-values in a longitudinal and transverse direction to the sprinkler stirrup.
Figure 5A:
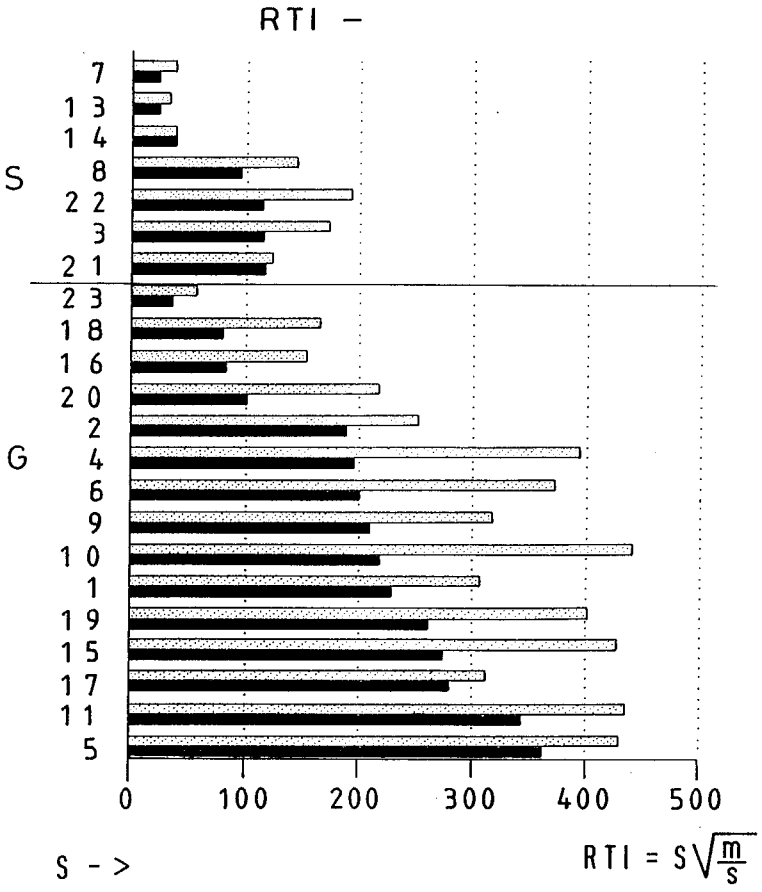
Figure 5B:
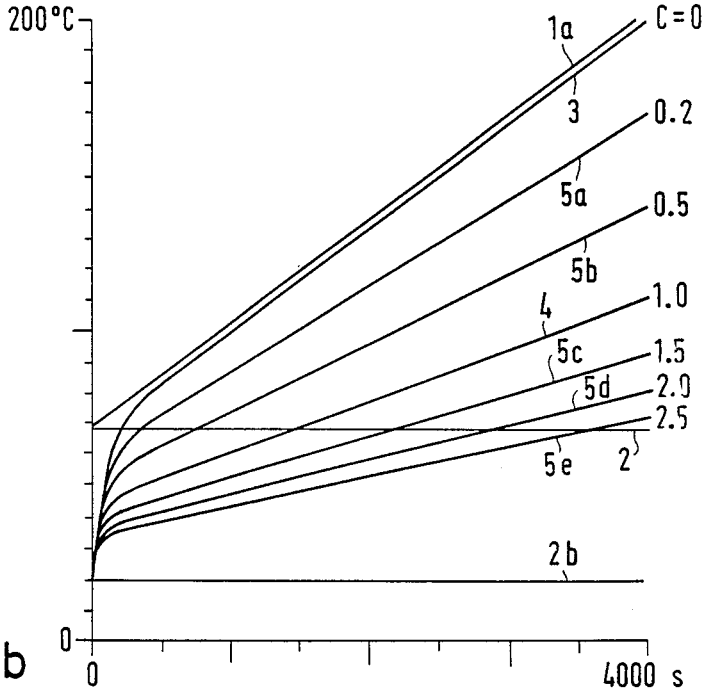
FIG. 5*b* shows the influence of different C-values on the minimum required speed of burnt gas for triggering of 1 m/sec and an assumed pipe temperature of 0° C., shown at an assumed temperature increase of the burnt gas of 2° C./min.
Figure 9:
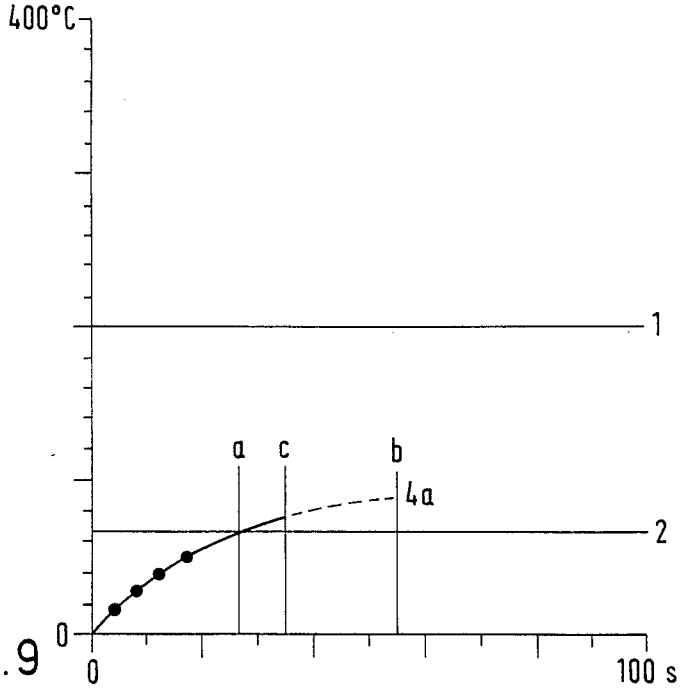
FIG. 9 shows a diagram of the influence of an predetermined breaking point on the triggering delay of the glass bulb.

In the diagram in FIG. 3, in which, as was again assumed in FIGS. 4, 5*b* and 9, the pipe and water temperature remains constant at 0° C., the burnt gas temperature is again 200° C., as in FIG. 2, but the speed of the burnt gas is only 1 m/sec as in FIG. 1. Here too, 68° C. was predetermined as the triggering temperature, and the sprinkler starting temperature is 0° C. From the broken curves 3 for C=0 or 4 for C=1 respectively, it can be seen that they intersect the triggering temperature straight line 2 at t=41 sec and t=56 sec respectively, i.e. at a considerable time lag in relation to each other. It follows from this that due to the supply of energy which is considerably lower than in the Examples of FIGS. 1 and 2, the C-value here plays a very considerable part with respect to the triggering behaviour.

This is made even more considerably clear by the diagram in FIG. 4, wherein according to line 1 the burnt gas temperature is 130° C. and the speed of the burnt gas is again set at 1 m/sec. The triggering temperature and the sprinkler starting temperature are unchanged at 68° C. and 0° C. respectively. The curve 3 for C=0 intersects the triggering temperature curve 2 at t=73 sec, whereas the curve 4 for C=1 does not intersect the straight line 2, but rather only approaches it. However, this means nothing more than that at a C-value of 1 there is no response of the sprinkler at all here as a result of not achieving the triggering temperature. Therefore the C-value here takes on a quite decisive importance.

In the bar chart of FIG. 5*a* and FIG. 5*c* on the left in FIG. 5*a* the RTI-values for a series of known and conventionally used soldered and glass bulb sprinklers are plotted for oncoming flow through the burnt gas along and perpendicular to the sprinkler stirrup and on the right in FIG. 5*c* the corresponding C-values for most of these sprinklers are plotted in the same manner. As can be seen from this chart, among the soldered sprinklers sprinkler No. 13 and with reservations sprinkler No. 14 have relatively favourable values both for the RTI and for the C-values, whereas all the other soldered sprinklers either have an unfavourable RTI or C-value or predominantly even both.

The relationships are considerably less favourable in the case of glass bulb sprinklers, of which only sprinkler No. 23 has a favourable RTI value, but an unfavourable C-value, in particular in the case of oncoming flow through the burnt gases lengthwise to the sprinkler stirrup. In the case of all the other sprinklers, equally the RTI values and also the C-values are relatively high, particularly in the case of an oncoming flow lengthwise to the stirrup, which indicates long triggering times or triggering delays.

In the diagram in FIG. 5*b*, which also clearly shows the considerable influence of the C-value on the triggering delay and the minimum temperature required for triggering at a speed of the burnt gas of 1 m/sec, an initial burnt gas temperature of 70° C. at a regular temperature increase of 2° C./min (broken line 1*a*) was assumed. The triggering temperature (line 2) is again fixed at a constant 68° C., the sprinkler starting temperature here is fixed at 20° C. (line 2*b*) and the speed of the burnt gas is again 1 m/sec. As can be seen by the broken curves 3 and 4 for the values C=0 and C=1 respectively, these intersect the triggering temperature straight line 2 at approximately t=170 sec or t=1.375 sec. It can be seen by the curves 5*a* to 5*e* which have been drawn in for the additional C-values 0.2, 0.5, 1.5, 2.0 and 2.5 that the relationship between the minimum burnt gas temperature required for triggering and the nominal triggering temperature increases considerably. This relationship is additionally influenced by differing pipe temperatures and/or speeds of the burnt gas.

Figure 6:
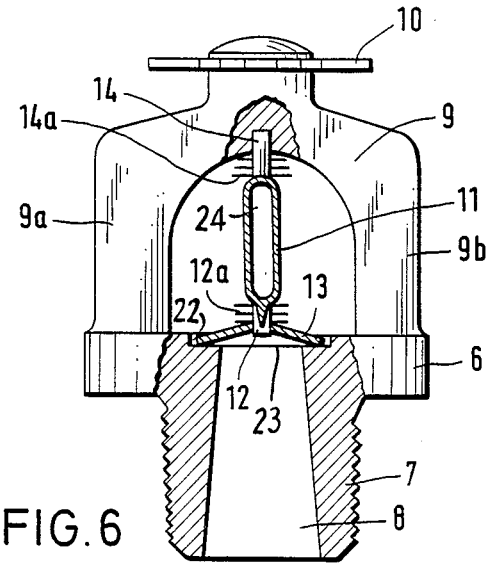
FIG. 6 shows a sprinkler head according to the invention with heat-insulating and heat-collecting components with a low heat storage capacity at both ends of the glass bulb.

In the sprinkler in FIG. 6, which is partially drawn in section, the collar 6 is provided with the threaded journal 7, the water through-hole 8 and with the stirrup 9, which holds the spray disc 10 in the conventional manner. The glass bulb 11 having axis 24 is supported on the collar 6 at its ends by the heat-insulating component 12 with the annular collar-shaped plates 12*a* and by the disc springs 13 sitting on valve seal 22 and also in the stirrup 9 by the heat-insulating component 14 with annular plates 14*a*. The heat-insulating components 12 and 14 are here designed as hollow cylinders, at least the hollow cylinder on the piping side being expediently closed facing the piping or water side in order to prevent direct contact between the water in the piping and the glass bulb 11, which would result in an unwanted flow of heat away from the glass bulb to the piping or water. The dissipation of heat can also be additionally reduced, for instance, in that the sealing member 23 which is conventionally used between the disc spring 13 and the sprinkler body is full-surfaced.

Of course, a seal could also be provided in another way. Both the components 12 and 14 and the plates 12*a* and 14*a* formed thereon are constructed with thin cross-sections so that they have a relatively low mass, but a large surface area in comparison. The disc springs 13 and the heat-insulating component 12 on the piping side are naturally arranged and constructed so that—if necessary with the aid of additional components or elements which are not shown—secure blocking off of the water is guaranteed until the point of triggering of the sprinkler.

The plates, collars or the like 12*a* and/or 14*a* may be made from the same high-strength corrosion-resistant material as the cylinders or cylinder sleeves 12 and 14, for instance from $V_2A$ steel $Cr_{18}Ni_8$ or also from another, particularly good heat-conductive, material such as copper, silver, nickel, aluminium or the like. In this case, the plates cause rapid heating-up of the components 12 and/or 14, which causes a thermal barrier to be built up between the glass bulb 11 and the collar 6 or the stirrup 9 which prevents heat being able to be conducted away from the glass bulb 11 to the collar or stirrup, or, with an appropriate layout and configuration, in particular if the plates adjacent to the glass bulb are in direct contact therewith, even heat is conducted to the glass bulb 11 from the components 12 and/or 14 and thus the triggering thereof is accelerated.

As well as the aforementioned $V_2A$ steel, for instance also chromium/nickel steel, steel with 36% Ni, Monel metal, which is a nickel-copper alloy containing approximately 65% nickel, 30% copper, and 5% other materials, especially manganese and iron, ceramic and glass may also be considered for use as a material for the heat-insulating components 12 and 14 due to their properties, in particular with respect to corrosion-resistance, high strength, low heat conductivity and also great heat absorption capacities but low heat storage capacities. However, more conductive materials may also be used if these can be compensated for, for instance, as a result of higher strength by lower material cross-sections. Compensation may also take place through longer insulating sections.

Figure 7:
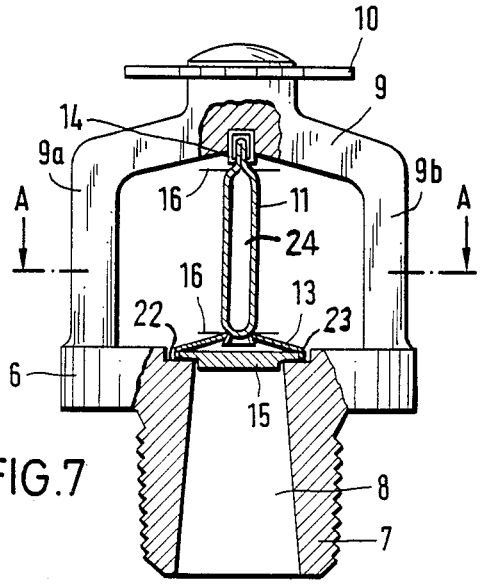
FIG. 7 shows a sprinkler head with an assembled heat-insulating component on the piping-side end of the glass bulb.

In the embodiment in FIG. 7, in which the same parts are again marked by the same references, the sealing plate 15 is arranged between the disc spring 13 and the sprinkler collar 6. The disc spring 13 here takes over the function of the heat-insulating component 12 and is therefore made from a material which has the properties required for this purpose. On the side of the stirrup, the heat-insulating component 14 is constructed here as a hollow cylinder which receives the sealed end of the glass bulb 11 and is made of a suitable material.

Between the glass bulb 11 and the components 13 (12) and 14, the collars or the like 16 which are made of copper or another highly heat-conductive material are arranged resting directly on the glass bulb, which collars or the like surround the end of the disc spring 13 (12) or of the hollow cylinder 14 which is adjacent to the glass bulb with flanging on the inside and are gripped between the components 13 (12) and 14. The thin collars 16 which serve as thermal collectors have a large surface area in comparison with their mass, which causes them to take up a large quantity of heat, and thus are heated up rapidly to a considerable extent by the burnt gases which occur in the case of a fire. Since only relatively little heat can be conducted away via the components 13 (12) and 14 due to their material properties and cross-sectional form, the collars form a heat barrier, so that removal of heat from the glass bulb to the sprinkler body can be at least suppressed as far as possible, and even, on the contrary, under certain circumstances heat may be conducted to the glass bulb. Here glass bulbs which are not thickened, but which, as has been conventional hitherto, are relatively thin-walled, in particular have positive results, and thereby facilitate the flow of heat from the collector into the expensive liquid.

Figure 8:
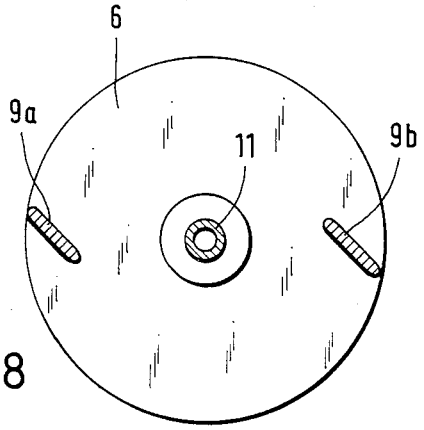
FIG. 8 shows a section thereof along the line A—A in FIG. 7.

In FIG. 8, which shows a simplified section through FIG. 7 along the line A—A, the cross-section of the sprinkler stirrup parts 9*a* and 9*b* relative to an imaginary connecting line which connects them together by their centres and passes through the axis of the glass bulb 11 is here at an angle of approximately 60° C., so that only little of the air or the burnt gases which has or have already cooled on the stirrup parts according to the direction of air flow also meets the triggering element, i.e. the glass bulb 11, which according to FIG. 5*b* is highly advantageous for improving the RTI and C-values. This principle can of course also be applied in the case of known three-armed or multi-armed stirrups.

In the diagram of FIG. 9, in which line 1 shows the constant burnt gas temperature of 200° C. and line 2 the intended triggering temperature of 68° C., the triggering behaviour of a sprinkler is plotted, taking into account a waiting period which occurs after the nominal temperature is reached. This waiting period can be put down to the heat which has to be produced at the moment of melting in the case of soldered sprinklers. But even with glass bulb sprinklers this waiting period occurs to a considerable extent. This waiting period can be determined by measuring, sprinklers with different starting temperatures being caused to trigger under given test conditions of burnt gas temperature and speed, and their triggering, times being determined. If the moment of triggering is selected as the reference time and the starting temperatures of the sprinklers tested is entered at a point in time which is displaced to the left by the amount of triggering time, the true heating-up curve of the triggering element, shown as an example by curve 4a, is obtained at least up to the nominal temperature. It can be seen from this that the glass bulb sprinkler started from 0° C. does not trigger after 27 seconds (line a) but after a longer period of delay, here after 56 seconds (line b). In contrast, the glass bulb provided according to the invention with a predetermined breaking point already triggers at a considerably earlier point in time and at a lower temperature (line c). The cause of this delay has at present not been investigated in enough detail. However, it is attributed to the part of the energy which is required to build up the pressure in the glass bulb. Furthermore, it is known that glass withstands higher stresses for a short time than in the long term. It can therefore perfectly well be assumed to be probable that the glass bulb withstands a higher temperature over a certain time span than the nominal temperature and the increased pressured connected therewith. Attempts have been made to express this phenomenon of triggering delay with an activation parameter. This has the unit °C. It can be imagined as if it represented the temperature difference between the actual triggering temperature of the glass bulb and the nominal triggering temperature.

The triggering temperature is the bursting temperature of the glass bulb, which is determined in a liquid with a slowly increasing temperature. The bursting temperature is determined by the filling capacity, matched to the type of the material used for filling, and by the bursting pressure of the glass bulb. The activation parameter depends on the type of the liquid which is poured in and the bursting pressure of the glass bulb.

At room temperature, the hermetically closed glass bulbs are not completely filled, but rather contain a cavity which looks like an air bubble, but which essentially is filled with vaporised expansive liquid as well as air which is enclosed in the glass bulb upon the hermetic closure thereof. With increasing temperature of the glass bulb, this cavity gradually disappears, and is no longer detectable at a few degrees Celsius below the bursting temperature, whereby it may be assumed that the liquid now completely fills the interior of the glass bulb. For this operation which is connected with a pressure increase with simultaneous suppression of expansion, the energy must first be applied by the heat flowing to the glass bulb, which energy, in the given glass bulb, is greater, the greater the compressibility K and the lower the coefficient of expansion of the filling liquid and the greater the specific heat $E_{spec}$ which is related to the volume of the liquid. The energy required becomes less, the greater the characteristic number formed from these values $$\frac{\gamma}{K \cdot E_{spec}} \left[ \frac{1/°C.}{1/\text{bar} \cdot \text{cal/grd cm}^3} \right]$$

which is for instance 100 for mercury, 27 for benzene and silicone fluid and 20 for glycerine and glycol. By selecting suitable substances, but also by suitable mixing, one thus has it well in hand to influence, i.e. reduce, the activation parameter.

The activation parameter can however also be reduced to a considerable extent by suitable configuration of the glass bulbs. The glass bulbs need to be permanently stable against longitudinal forces which occur which serve to hold the sealing member closed. Likewise, they need to be stable against bending forces. However, they do not need to be stable against increasing internal pressure, as this only increases in the case of heating, whereby the glass bulb upon heating to a predetermined triggering no longer has to withstand the internal pressure corresponding thereto, but rather is intended to trigger by self-destruction and to activate the sprinkler by opening the seal.

In FIG. 10a, a conventionally constructed glass bulb 11 with an even wall thickness over its entire extent is shown on a greatly enlarged scale and in a cross-section in a top view. According to FIG. 10d, the pressure in the glass bulb first only increases very slowly with increasing heating and progressing time, then increases greatly relatively suddenly, i.e. within an additional, relatively small temperature range, until finally the relatively high bursting pressure $P_{Berst}$, at which the glass bulb then is broken as intended, is reached at the temperature $T_{Berst}$. In FIG. 10b the glass bulb 11 is shown in the same way as in FIG. 10a, but now provided with the predetermined breaking point 17. According to FIG. 10e, the predetermined breaking point results in a very much lower bursting pressure $P_{Berst}$ and hence also a lower energy which is required to build up the pressure. Also the excessive increase in temperature which otherwise occurs in the event of a rapid temperature increase is considerably reduced.

One example of the configuration of the predetermined breaking point 17 is shown in the greatly enlarged longitudinal section through the glass bulb 11 in FIG. 10c. The predetermined breaking point is thereby constructed as a groove-like recess which is crescent-shaped when viewed, so that the occurrence of notch stresses is avoided. Other forms of the predetermined breaking point than those shown in FIGS. 10b and 10c are of course conceivable and producible. Likewise, two or more predetermined breaking points, preferably regularly spaced across the periphery of the glass bulb, may be provided instead of a single predetermined breaking point.

Figure 11:
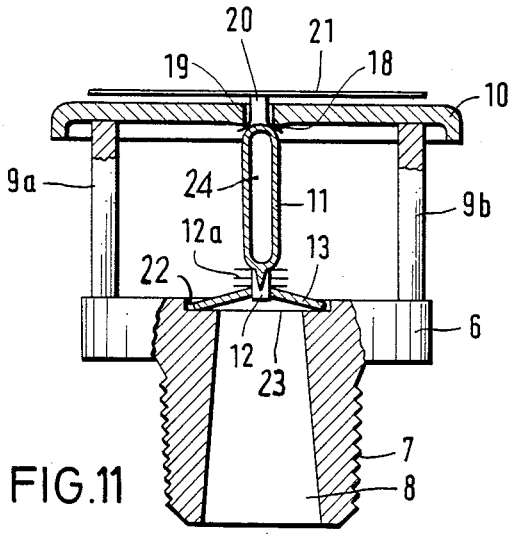
FIG 11 shows a further example of embodiment, with a thermal collector arranged on the outside of the spray disc.

In the embodiment in FIG. 11, in which the same parts again are provided with the same references, the spray disc 10 is attached to the collar 6, which is provided with the threaded journal 7, by the stirrup arms 9a and 9b. The glass bulb 11 is supported on the collar 6 by means of the heat-insulating component 12, which is again sealed at one end and provided with the ribs, plates or the like 12a via the disc spring 13, which acts as a sealing member, and on the spray disc 10 via the inside flanging 18 of the thermal collector which passes through the central opening 19 in the spray disc 10 and is constructed as a hollow cylinder 20 with an external, thin disc 21 having a large surface area. Of course, a particularly suitable material such as copper or the like is used for the thermal collector 20, 21 and, of course, here too secure sealing is ensured by the disc spring 13, optionally by using additional sealing means.

Within the scope of the invention, instead of the sprinklers shown in FIGS. 6 to 8 by way of example, one is moved to use other configurations of sprinklers in conjunction with heat-insulating components which are constructed in other ways, without or with ribs, plates, discs or the like which may optionally act as thermal collectors, as long as the above-mentioned criteria which are essential to the invention are correctly taken into account in so doing.

I claim:

1. A thermal triggering device for sprinklers for stationary fire-extinguishing systems, with a triggering element comprising a glass bulb, filled with an expansive liquid, which is gripped at ends thereof between a piping-side sealing member comprising a valve disc, which bears on a valve seat, and an outer support comprising a substantially U-shaped stirrup supporting a spray disc, and holds the sealing member in the closed position until the moment of triggering, wherein the glass bulb (11) is at least supported on the sealing member (13) directly via a heat-insulating component (12), made from a corrosion-resistant material of high strength and low heat conductivity and also great heat absorption but low heat storage capacities, said material selected from the group consisting of chromium/nickel steel comprising $Cr_{18}Ni_8$, steel with 36% Ni, a nickel-copper alloy containing approximately 65% nickel, 30% copper, and 5% other materials, and ceramic, said component having a low mass and a large surface area and a small cross-section in the direction of the flow of heat.

2. A thermal triggering device according to claim 1, wherein the heat-insulating component (12) is formed from several individual parts.

3. A thermal triggering device according to claim 1, wherein the piping-side heat-insulating component (12) comprises a hollow cylinder.

4. A thermal triggering device according to claim 3, wherein the hollow cylinder is closed at one end which is remote from the glass bulb (11).

5. A thermal triggering device according to claim 1, wherein the piping-side heat-insulating component (12) is separated from direct contact with the water by a seal located beneath the sealing member (13).

6. A thermal triggering device according to claim 1, wherein the heat-insulating component is provided with at least one rib-like extension (12*a*).

7. A thermal triggering device according to claim 6, wherein the rib-like extension (12*a*) is constructed as a thermal collector from a highly heat-conductive material selected from the group comprising copper, silver, nickel, aluminum.

8. A thermal triggering device according to claim 6, wherein the rib-like extension (12*a*) is constructed as at least one plate-like, thin leaf, thin disc which extends substantially perpendicularly to an axis of the glass bulb.

9. A thermal triggering device according to claim 1, wherein the glass bulb has a supporting region which is thin-walled.

10. A thermal triggering device according to claim 1, wherein the glass bulb (11) contains a filling of materials with a lower specific heat with respect to the volume.

11. A thermal triggering device according to claim 1, wherein the glass bulb (11) contains a filling of materials which expand greatly upon the heating thereof.

12. A thermal triggering device according to claim 1, wherein the glass bulb (11) contains a filling of highly heat-conductive and poorly compressible materials.

13. A thermal triggering device according to claim 1, wherein the glass bulb (11) has a predetermined breaking point (17) which responds at a predetermined level of its internal pressure.

14. A thermal triggering device according to claim 13, wherein the predetermined breaking point (17) is designed as an approximately V-shaped groove which extends over at least part of the axial length of the glass bulb (11) and is arranged on the outside of the glass bulb.

15. A thermal triggering device according to claim 13, wherein the predetermined breaking point (17) is formed by the engraving of grinding of the glass bulb (11).

16. A thermal triggering device according to claim 1, wherein the glass bulb (11) is filled, free of air, with benzene or silicone fluid.

17. A thermal triggering device according to claim 1, wherein the stirrup (9) of the sprinklers has a streamlined configuration.

18. A thermal triggering device according to claim 1, wherein the stirrup (9) has arms (9*a*; 9*b*) with a cross-section which passes through an axis of the glass bulb (11) inclined at an angle.

19. A thermal triggering device according to claim 1, wherein the cross-section of the arms (9*a*, 9*b*) of the stirrup (9) is inclined at an angle of about 15° to 60°, in particular 40°.

20. A thermal triggering device according to claim 1, wherein the glass bulb (11) is connected by means of an intermediate member made of a highly heat-conductive material to a thermal collector which is arranged outside the stirrup (9), made of a highly heat-conductive material and constructed with a large surface area.

* * * * *